US007942097B1

(12) United States Patent
Alam et al.

(10) Patent No.: US 7,942,097 B1
(45) Date of Patent: May 17, 2011

(54) MODULAR INITIATOR WITH INTEGRATED OPTICAL DIAGNOSTIC

(75) Inventors: M. Kathleen Alam, Cedar Crest, NM (US); Randal L. Schmitt, Tijeras, NM (US); Eric J. Welle, Niceville, FL (US); Sean P. Madden, Arlington, MA (US)

(73) Assignee: Sandia Corporation, Albuquerque, NM (US)

( * ) Notice: Subject to any disclaimer, the term of this patent is extended or adjusted under 35 U.S.C. 154(b) by 192 days.

(21) Appl. No.: 12/397,705

(22) Filed: Mar. 4, 2009

Related U.S. Application Data

(60) Provisional application No. 61/034,385, filed on Mar. 6, 2008.

(51) Int. Cl.
*F42C 13/02* (2006.01)
*F42C 15/00* (2006.01)

(52) U.S. Cl. ..... 102/201

(58) Field of Classification Search ..... 102/201, 102/202.3, 202.4
See application file for complete search history.

(56) References Cited

U.S. PATENT DOCUMENTS 4,471,697 A 9/1984 McCormick et al.
4,602,565 A 7/1986 MacDonald et al.
4,644,154 A * 2/1987 Brogårdh et al. ..... 250/227.23
4,735,145 A 4/1988 Johnson et al.
4,917,014 A * 4/1990 Loughry et al. ..... 102/201
4,928,595 A 5/1990 Weingart
5,007,661 A * 4/1991 Lenzen ..... 280/735
5,029,528 A * 7/1991 Paisley ..... 102/201
5,229,542 A * 7/1993 Bryan et al. ..... 102/491
H1366 H 11/1994 Bickes, Jr. et al.
5,370,053 A 12/1994 Williams et al.
5,406,889 A * 4/1995 Letendre et al. ..... 102/201
6,158,347 A 12/2000 Neyer et al.
6,173,650 B1 1/2001 Garvick et al.
6,178,888 B1 1/2001 Neyer et al.
6,467,803 B2 * 10/2002 Dirmeyer et al. ..... 280/731
6,470,801 B1 * 10/2002 Swart et al. ..... 102/201
6,499,404 B1 * 12/2002 Kern et al. ..... 102/201
6,964,231 B1 * 11/2005 Robinson et al. ..... 102/235
2005/0039625 A1 * 2/2005 Rastegar et al. ..... 102/213

* cited by examiner

*Primary Examiner* — Bret Hayes
(74) *Attorney, Agent, or Firm* — Carol I Ashby

(57) ABSTRACT

A slapper detonator which integrally incorporates an optical wavequide structure for determining whether there has been degradation of the explosive in the explosive device that is to be initiated by the detonator. Embodiments of this invention take advantage of the barrel-like character of a typical slapper detonator design. The barrel assembly, being in direct contact with the energetic material, incorporates an optical diagnostic device into the barrel assembly whereby one can monitor the state of the explosive material. Such monitoring can be beneficial because the chemical degradation of the explosive plays an important in achieving proper functioning of a detonator/initiator device.

16 Claims, 4 Drawing Sheets

MODULAR INITIATOR WITH INTEGRATED OPTICAL DIAGNOSTIC

This patent application claims priority benefit from U.S. provisional patent application Ser. No. 61/034,385, filed on Mar. 6, 2008, which is incorporated herein by reference.

The United States Government has rights in this invention pursuant to Department of Energy Contract No. DE-AC04-94AL85000 with Sandia Corporation.

BACKGROUND OF THE INVENTION

This invention relates to devices for the initiation of chemical reactions. Initiators are devices that initiate a chemical reaction, and in many cases an initiator will initiate an energetic output which then can be used to drive another chemical reaction such as a pyrotechnic, propellant or detonation output. Initiators or detonators induce hot spots within the energetic material. These hot spots induce deflagration, ultimately leading to detonation. Hot spots can be induced in a number of ways, including heat, friction and compression.

Applications which require precise timing typically use electrical initiators rather than mechanical initiators. The three common types of electrical initiators are hot wire, exploding bridgewire (EBW) and slapper. The slapper detonator has distinct advantages in terms of efficiency, safety and reliability after aging. A shock is delivered to the explosive energetic material through a high impact flyer (or 'slapper'). The impact is high enough to detonate the explosive. The slapper is commonly constructed of thin plastic or metal and is driven by a plasma created by passing a large amount of current through a thin metal wire or strip.

Some advantages of a slapper detonator are 1) the energy required to fire is low; 2) insensitive explosives can be initiated directly; 3) a larger area of the explosive is impacted and thus slappers are more efficient than EBWs; 4) the foil is not in direct contact with the explosive before firing, thus reducing the potential for undesirable chemical interactions. The basic design elements of a slapper detonator are 1) lead wires, 2) header, 3) exploding foil or wire, 4) flyer plate, 5) barrel assembly, 6) high-density explosive, and 7) cup.

BRIEF DESCRIPTION OF THE DRAWINGS

The accompanying drawings, which are incorporated in and form part of the specification, illustrate some embodiments of the present invention and, together with the description, serve to explain the principles of the invention.

FIG. 7 illustrates schematically an embodiment with a horse-shoe-shaped waveguide.

FIG. 8 illustrates schematically some possible trench shapes.

DETAILED DESCRIPTION OF THE INVENTION

Figure 1:
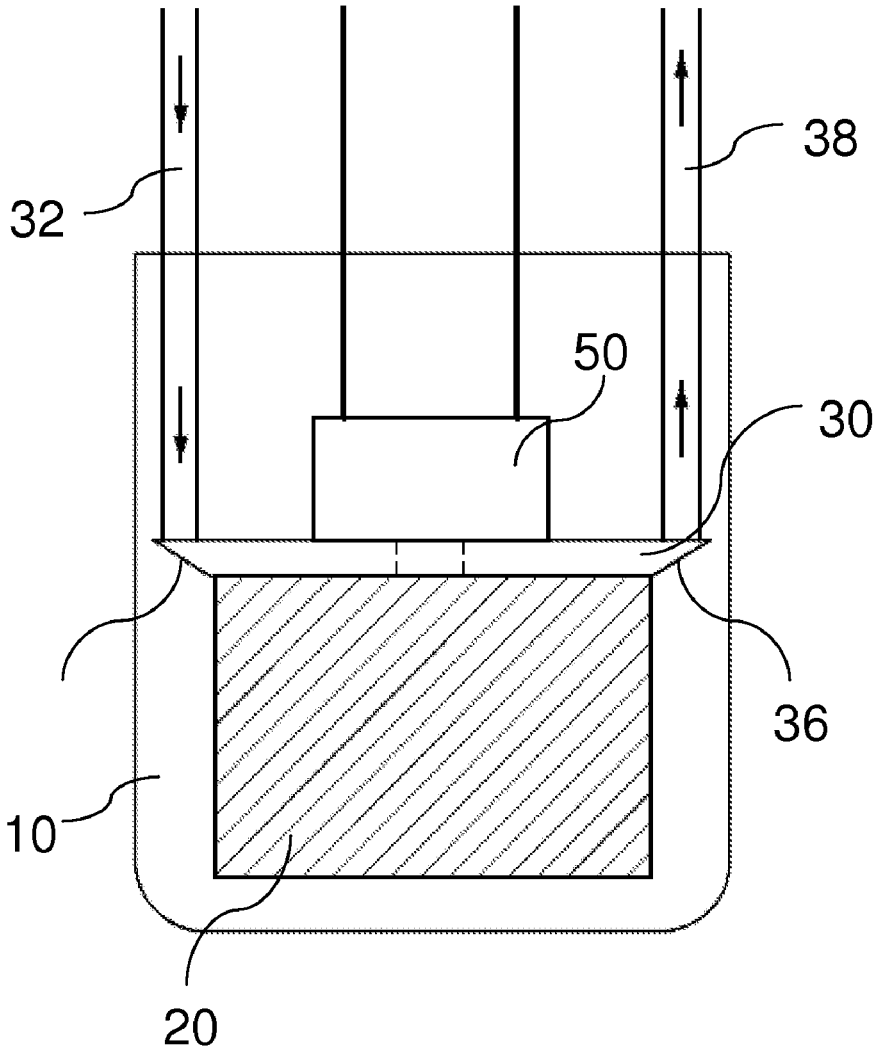
FIG. 1 illustrates schematically an embodiment of the invention.

This invention comprises a slapper detonator which integrally incorporates a means for determining whether there has been degradation of the explosive and/or flyer plate in the explosive device that is to be initiated by the detonator. Embodiments of this invention take advantage of the barrel-like character of a typical slapper detonator design. The barrel assembly, being in direct contact with the energetic material as well as having access to the flyer plate material, may be designed to incorporate a diagnostic sensor to characterize the most critical elements of the detonator/initiator device. By incorporating an optical diagnostic device into the barrel assembly, one can monitor the state of the explosive material and/or the surface of the slapper. Such monitoring can be beneficial because the conditions of each play important roles in the proper functioning of a detonator/initiator device.

It is well established in the art that degradation of the explosive material (EM) will cause reduced output of the final device. For example, exposure of HNS (hexanitrostilbene, an insensitive high explosive) to amines causes a noticeable color change due to chemical changes in the material. Explosive material degradation has been observed when HNS pellets are exposed to diethylenetriamine (DETA) for extended periods of time. The amount of voltage needed to reach detonation has been determined for several pellets with differing levels of degradation. Increased voltages were required to fire each pellet as increase degradation of the EM surface occurred. In one study, a linear dependence of firing voltage on the time exposed to DETA has been observed. Thus, it is important to know the degree of degradation of the explosive to enable selection of a suitable voltage for reliable firing.

Chemical degradation can be spectroscopically monitored using optical spectroscopy. A wide range of wavelengths, including those from the ultraviolet to infrared region, can be used to monitor the energetic material. For example, the infrared (IR) spectrum of a material is useful for detecting chemical changes that result in different molecular vibrations. For example, when the IR spectra of HNS pellets is measured using an attenuated total reflectance (ATR) sampler within a FTIR (Fourier-transform infrared) spectrometer, the IR spectra show changes in the vibrational spectra that are due to changes in the chemical structure as degradation proceeds. The quantitative change in spectral peaks corresponding to regions of the molecule that are changing provides a quantitative measurement of the extent of degradation. Such changes can be used to select a suitable detonation voltage or to determine whether the material is capable of proper detonation. In various embodiments, the waveguide and probe light can be selected to permit sampling a wide range of wavelengths or a relatively narrow wavelength range can be used when a relatively narrow absorption region is to be monitored. When a suitable waveguide substrate material is used, embodiments of the waveguide device of this invention can allow a relatively wide energy region to be sampled, which can increase the ability to spot multiple contamination sources. For example, with a silicon waveguide substrate, the infrared region between 4000 and 1000 $cm^{-1}$ can be monitored as a chemical fingerprint of the energetic material.

FIG. 1 presents a schematic illustration of an embodiment of the invention. A casing cup 10 contains the explosive material 20. The waveguide substrate 30 is proximate to the explosive material and in optical contact such that evanescent waves of light traversing through a waveguide 31 formed in the waveguide substrate will be absorbed at wavelengths corresponding to spectral features of the explosive material and/or its degradation products. The waveguide can be laterally defined by trenches in the substrate or by patterned alteration of the refractive index of the waveguide substrate by processes such as diffusion or ion implantation. When using diffusion or ion implantation, one can either lower the refractive index of regions of the waveguide substrate to form a lower-index confining region, or one can raise the refractive index to form the waveguide in the waveguide substrate. The light is introduced into the waveguide using, for example, an optical fiber or a hollow waveguide 32. The light enters the waveguide through the waveguide surface that is not in direct contact with the explosive material. It is turned into the waveguide by an angled surface 34, traverses the length of the waveguide, and is reflected by a second angled surface 36 into the output optical fiber or hollow waveguide 38. In some embodiments, the waveguide substrate functions as the barrel of the slapper detonator, with an aperture through the waveguide substrate that allows passage of the flyer plate. In some embodiments, the waveguide substrate comprises the portion of the barrel assembly that is in contact with the explosive and an additional layer of material with an aperture aligned with the aperture in the waveguide substrate can also be part of the barrel assembly.

Figure 2:
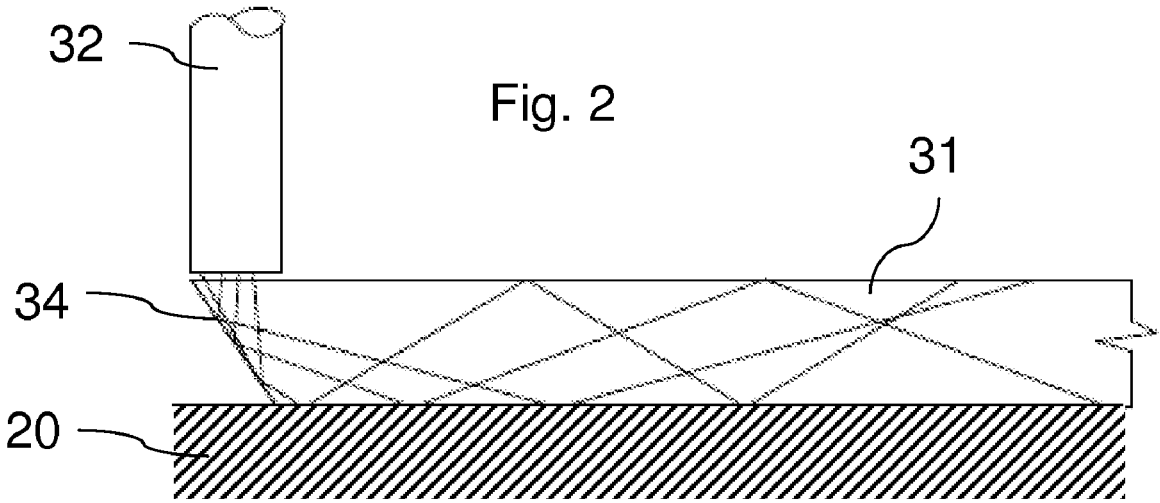
FIG. 2 illustrates an embodiment that employs a fiber or hollow waveguide to input light to the waveguide by reflection of an angled mirror surface.

FIG. 2 illustrates rays of light entering the waveguide 31. The light enters through the waveguide surface, is turned at the mirror 34, and traverses along the waveguide 31, interacting with the energetic material 20. The energetic material can be in contact with the planar proximate surface as in FIG. 1 or in contact with both the planar proximate surface and the turning mirror surface of the waveguide, as in FIG. 2. In some embodiments, the turning mirror surface may be coated with a cladding layer.

Figure 3:
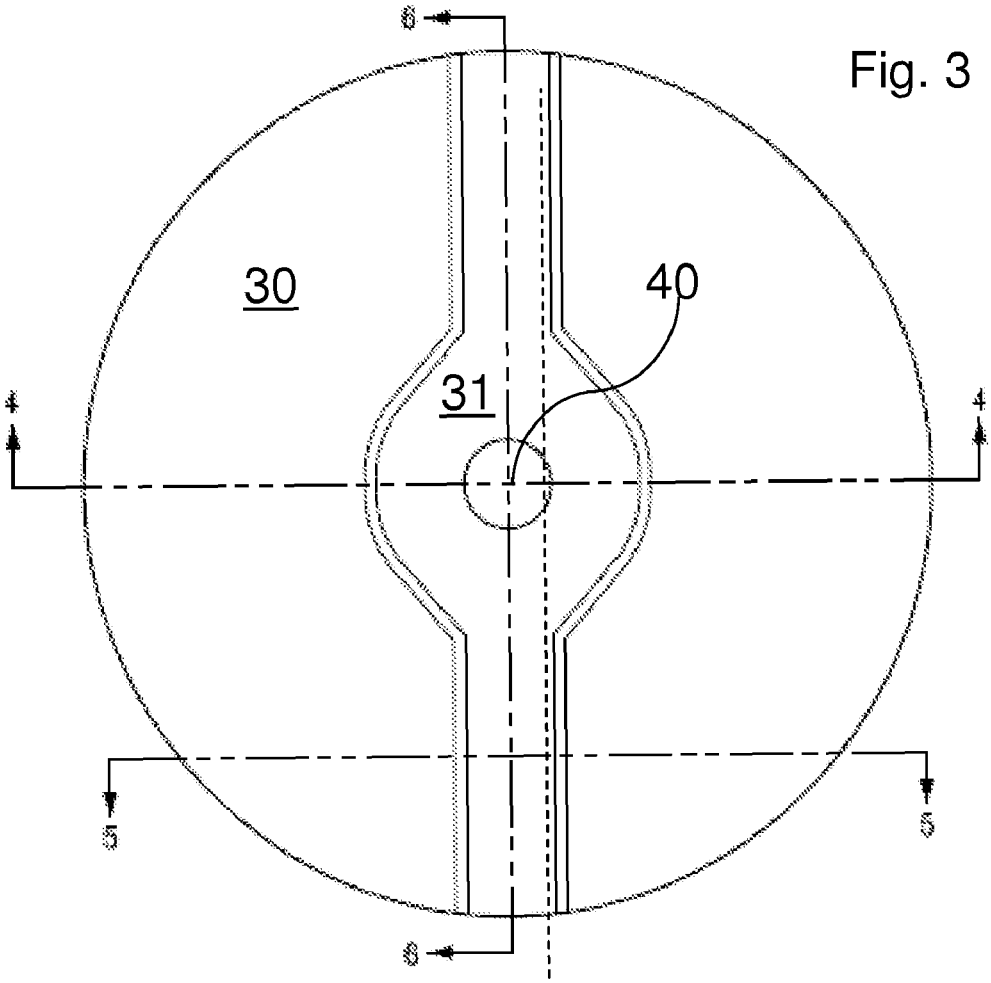
FIG. 3 illustrates schematically a bifurcated waveguide embodiment.
Figure 4:
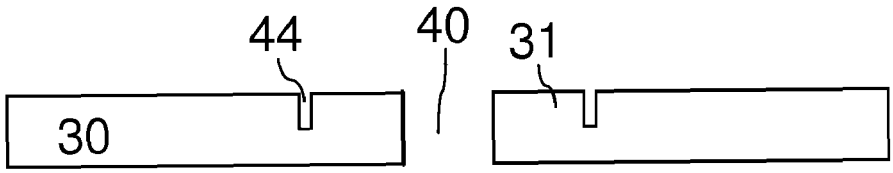
FIG. 4 illustrates a cross section through the aperture and bifurcated waveguide section of the embodiment in FIG. 3.
Figure 5:
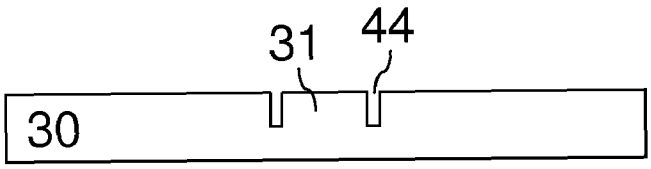
FIG. 5 illustrates a cross section through a waveguide section of the embodiment in FIG. 3.
Figure 6:
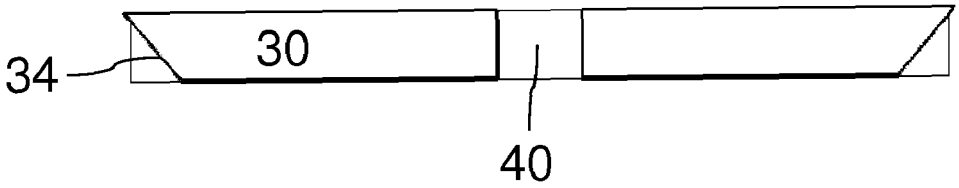
FIG. 6 illustrates a cross section along the waveguide section of the embodiment in FIG. 3 showing the beveled edges for turning light into the waveguide.

FIG. 3 presents a schematic diagram of the waveguide substrate of one embodiment. A top view is presented FIG. 3*a*. Grooves 44 in the surface of the waveguide substrate 30 define the waveguide 31. In this embodiment, the waveguide bifurcates as it passes around the aperture 40 through which the flyer plate will pass. Three cross sections are presented in FIGS. 4-6 showing the bifurcated section around the aperture 40, the waveguide 31 in the region of the substrate away from the aperture, and the beveled edges that provides mirror surfaces 34 and 36 for optical input and output.

Figure 7A:
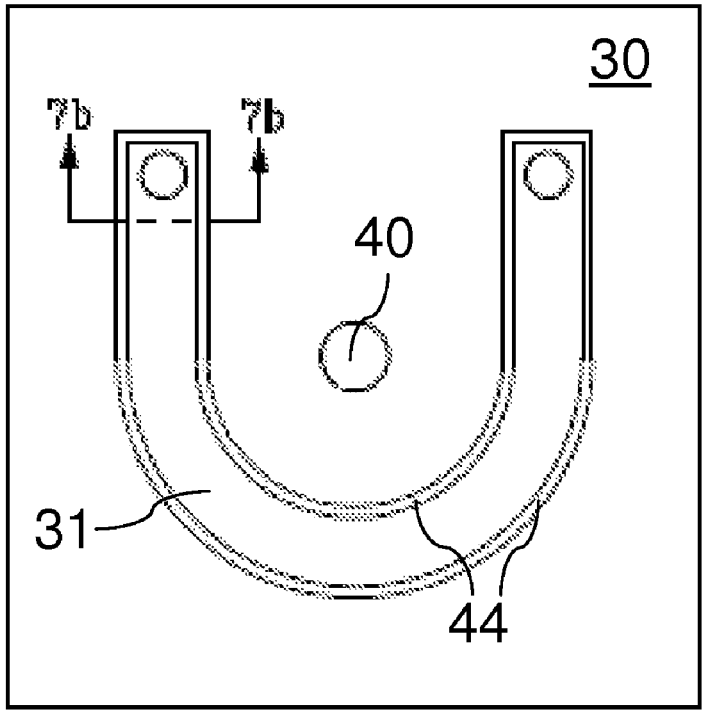
FIG. 7*a* is a top plan view.
Figure 7B:
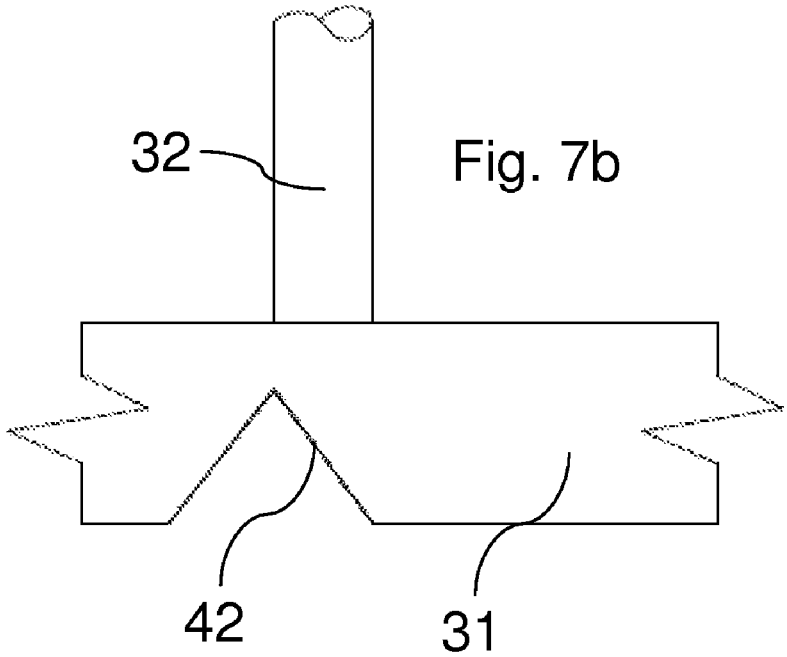
FIG. 7*b* illustrates an etched mirror for introducing light into the waveguide.

FIG. 7 presents a schematic diagram of the waveguide substrate of another embodiment. In this embodiment, the waveguide substrate 30 is square and trenches 44 define a horse-shoe-shaped waveguide, as illustrated in FIG. 7*a*. The angled mirror 42 (FIG. 7*b*) for introduction and extraction of light are formed away from the edge of the waveguide substrate. One way in which such mirrors can be formed is by anisotropic etching to selectively expose certain crystallographic planes. For example, in embodiments where the waveguide substrate is a Si(100) wafer, one can selectively expose Si(111) planes using an anisotropic KOH etch. Crystallographically selective etches can be used for many crystalline materials that are suitable for waveguides in embodiments of this application.

The waveguide substrate can be of a variety of shapes; the shape can be selected to be suitable for incorporation in a particular slapper detonator. The waveguide shape can also be varied extensively, according to the need of a particular slapper detonator. A bifurcated linear design is illustrated in FIG. 3 and a horse-shoe-type shape is illustrated in FIG. 7. Other geometric designs that suitably confine the light without excessive loss are intended to be included in the scope of this invention.

The waveguides described in the detailed embodiments are ridge waveguides formed by making trenches in the waveguide substrate. Other types of waveguides, such as those formed by altering the refractive index through altering the material, can also be used in embodiments of this invention. Examples include planar diffused optical waveguides, where the refractive index of the waveguide substrate is locally altered by in-diffusion of chemical species. Examples include but are not restricted to the diffusion of $Br^-$ ions into AgCl substrates to form mid-IR waveguides or the formation of planar glass waveguides by localized ion exchange. Many workable combinations can be developed by those of skill in the art of optical materials. It is intended that waveguides of any type suitable for incorporation into the detonator device proximate to the energetic material are within the scope of this invention.

In various embodiments, an angled surface on the side opposite the light input/output side is used as the mirror surface for introducing and extracting light. The angled surface can be located in different regions of the waveguide substrate, depending on what is desired for a particular embodiment. In some embodiments, a beveled edge can be formed at a pair of locations at the perimeter of the waveguide substrate, such as is illustrated schematically in FIG. 1. In other embodiments, light can be coupled into and out of the waveguide using mirror surfaces not located at the waveguide substrate perimeter. For different embodiments, the mirror surface can be located at a variety of locations on the waveguide substrate. Proper alignment of an etch mask with respect to the crystallographic planes is combined with a crystallographically selective etching process. A wide range of crystallographically selective etches are known to those of skill in the etching art for a wide range of materials. For example, one can expose Si(111) planes with crystallographic etching process such an anisotropic KOH etching process, producing a v-groove when forming a trench and a pyramidal pit when etching a blind hole such as would be used for the mirror in FIG. 7*b*.

Figure 8A:
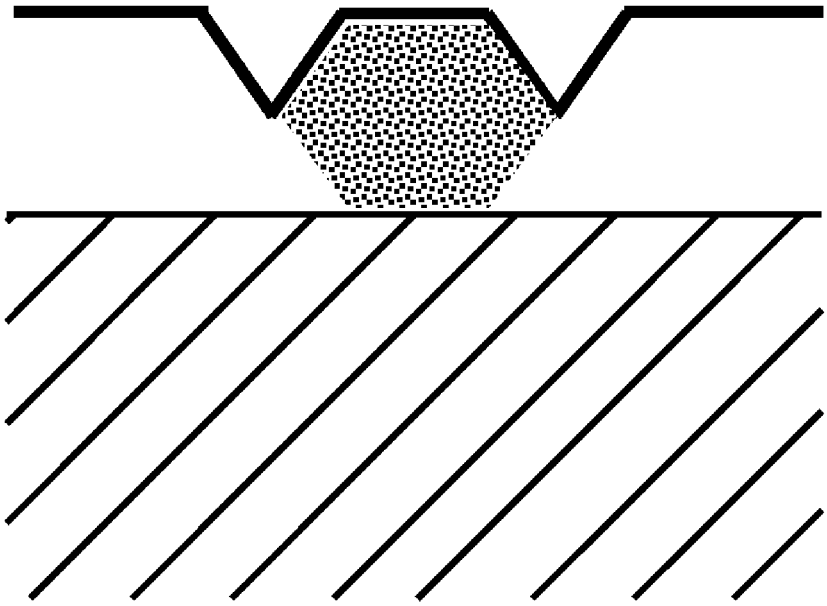
FIG. 8*a* illustrates a cross section of a waveguide defined by v-groove trenches.
Figure 8B:
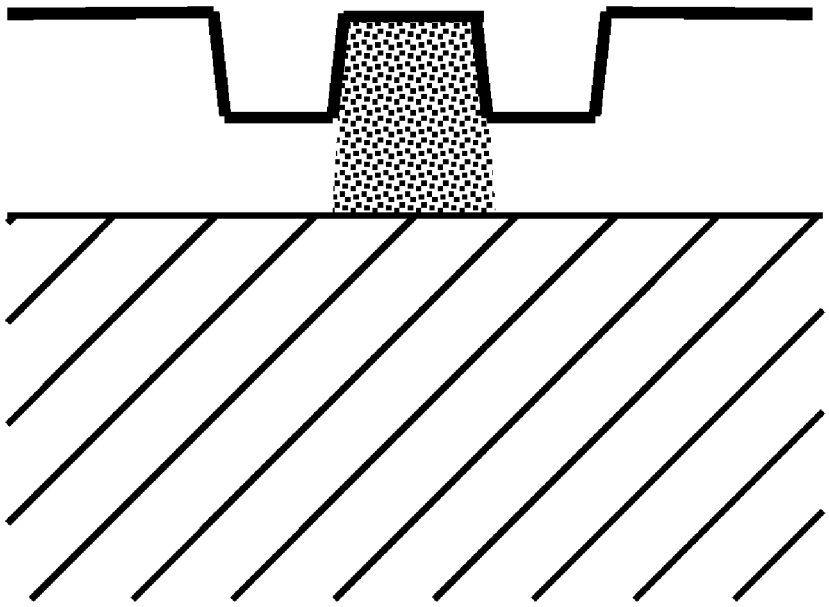
FIG. 8*b* illustrates a cross section of a waveguide defined by approximately rectangular troughs.

The grooves that define the edges of ridge waveguides can be of a variety of different cross sections. Two possible cross sections are illustrated in FIG. 8. In FIG. 8*a*, the groves have angled walls such as would be obtained by selective crystallographic etching. For a Si(100) waveguide substrate, etching grooves using an anisotropic KOH etchant produces a ridge waveguide. The anisotropic KOH etch produces very smooth walls that minimize scattering loss in the waveguide. Angles not defined by the location of crystallographic planes can be obtained using dry etch processing with reflowed resists to define the etched angle. A brief isotropic wet etch can be used to smooth the dry-etched surface if needed to improve optical quality. In FIG. 8*b*, the walls are trenches such as would be obtained with lithographically patterned reactive ion etching.

A variety of groove depths can be used in various embodiments of the invention. In some embodiments, the grooves have a depth on the order of half the thickness of the waveguide substrate. This depth provides good optical confinement while not weakening the substrate so much that it breaks easily along the grooves. However, the depth is not critical as long as it provides sufficient optical confinement. Deeper grooves improve optical confinement but make the assembly weaker (more likely to break along the grooves).

In various embodiments the geometric pattern of the waveguide can be varied as desired. FIGS. 2 and 3 illustrate a waveguide configuration where the light is input and output from the waveguide at opposite edges of the waveguide substrate. In the embodiment illustrated in FIG. 7, light is input and output by abutting an optical fiber or a hollow waveguide against the surface opposite an angled mirror.

One side of the waveguide is proximate to and in optical contact with the material being sensed (or probed). For ridge waveguides, the grooves that define the waveguide can be on the side proximate to the energetic material or on the opposite side of the waveguide substrate. The opposite side of the waveguide can be protected from contamination from dust or dirt or from contact with any other material that may cause loss (especially if the loss has a wavelength dependence, and, as a result, would interfere with the spectrum of the material being probed). One way to protect this side of the waveguide is to coat the second side of the waveguide with a cladding material. For example, for a Si waveguide (with n=3.4), a thin coating (½ wavelength or more) of ZnS (n=2.27) applied to the surface not in contact with the explosive material would provide a cladding layer (that is, ensure total internal reflection) and would allow other materials to contact the ATR waveguide assembly without causing unintended variable-wavelength losses. As with the selection of the waveguide material itself, there are some constraints on choosing a cladding material for better performance. First, the material should have an index of refraction that is less than that of the waveguide itself (to ensure total internal reflection). Second, the material should have high optical transmission in the wavelength range that the waveguide is intended to operate; this avoids attenuation of the evanescent wave in the cladding. In some embodiments, ZnS can be employed as a cladding for a Si waveguide. The coating material for a particular embodiment is selected with consideration of whether the interaction of the light with the coating will cause spectral features that may interfere with the detection of changes in the spectra of the energetic material.

Waveguides suitable for ATR can be fabricated from a variety of optical materials guided by two main principles: first, the material must be optically transparent over the intended range of use; and, second, the material must have an index of refraction higher than that of the material being probed. Examples of other waveguide materials include but are not restricted to silicon for the infrared region, fused silica or quartz for the visible to near-ir region, ZnSe for use between 600 and 20 microns, ZnS for 450 nm to 14 microns, germanium for 2 to 17 microns and sapphire ($Al_2O_3$) for 150 nm to 5 microns. For a particular embodiment, one would choose the material with an appropriate index of refraction to achieve the desired penetration depth of the evanescent wave, where a higher the index of refraction difference between the waveguide and the probed material yields a lesser penetration depth that can be achieved at a given angle of incidence. The index ratio also controls the maximum ray propagation angle before the ray exceeds the critical angle for total internal reflection and is lost. The mathematical expressions relating these parameters are well known to those skilled in the optical art and can be used to optimize the design of a waveguide ATR system for any wavelength region desired.

A very wide range of slapper detonator designs can be used in embodiments of this invention since the waveguide substrate serves as the part of the barrel assembly that is in contact with the energetic material, i.e., the explosive.) Many different designs of flyer assembly can be employed in embodiments of this invention where the waveguide substrate serves as all or part of the barrel assembly. Similarly, the flyer plate or slapper can be of many different types as known to those of skill in the art.

Embodiments of this invention can serve as detonators in a wide range of sizes. There is not an upper size limitation since the waveguide substrate can cover all or part of the surface of the explosive material. The lower size limitation is set by the need to provide for input and output of the light while having an aperture of sufficient size to allow passage of the flyer plate.

The waveguide substrate with the barrel aperture need not fill entire cross section of the casing or cup as long as it is aligned such that the aperture allows passage of the flyer plate so it can strike the energetic material. In the preceding embodiments, the waveguide substrate serves as the barrel through which the flyer plate will pass; in some embodiments, the waveguide might not comprise the aperture through which the flyer plate is accelerated to cause initiation. Rather, it may be offset from the aperture region as long as it is proximate to the explosive material to enable measurement of spectral changes of the explosive material. The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A slapper detonator comprising:

a cup containing an energetic material;

a flyer plate assembly operably engaged with the cup;

a barrel assembly comprising an optical waveguide structure within the cup and between the flyer plate assembly and the energetic material, the optical waveguide structure having an aperture therethrough oriented to permit passage of a flyer plate from the flyer plate assembly through the aperture to the energetic material; the optical waveguide structure comprising an optical waveguide that is positioned to be proximate to and in optical contact with the energetic material; and means for coupling light into and out of the optical waveguide.

2. The slapper detonator of claim 1, wherein a shape of the aperture is selected from the group consisting of a circle, an oval, and a polygon.

3. The slapper detonator of claim 1, further comprising a coating on a surface of the optical waveguide structure that is opposite a surface of the optical waveguide structure that is proximate to the energetic material.

4. The slapper detonator of claim 3, wherein the optical waveguide is made of silicon and the coating is ZnS.

5. The slapper detonator of claim 1, wherein the means of coupling light into and out of the optical waveguide is selected from an optical fiber, a hollow light waveguide, and a focusing optical system.

6. The slapper detonator of claim 1, wherein the means for coupling light into and out of the optical waveguide is selected from an optical fiber, a hollow light waveguide, and a focusing optical system.

7. A slapper detonator comprising a cup containing an energetic material;

a flyer plate assembly operably engaged with the cup;

a barrel assembly comprising an optical waveguide structure within the cup and between the flyer plate assembly and the energetic material, the optical waveguide structure having an aperture therethrough oriented to permit passage of a flyer plate from the flyer plate assembly through the aperture to the energetic material; the optical waveguide structure comprising a waveguide substrate comprising an optical waveguide that is positioned to be proximate to and in optical contact with the energetic material;

an input mirror and an output mirror integrated with the waveguide substrate, wherein the input mirror directs light into the optical waveguide and wherein the output mirror directs light out of the optical waveguide;

at least two light-confining features in a guiding surface of the waveguide substrate that define the optical waveguide and that laterally confine the light to a sensing region of the waveguide substrate that is proximate to the energetic material; and means for coupling light into and out of the optical waveguide.

8. The slapper detonator of claim 7, wherein the input and output mirrors are beveled edges of the waveguide substrate.

9. The slapper detonator of claim 7, wherein the at least two light-confining features are trenches having a cross section selected from a v-shape, a substantially rectangular shape, and a substantially trapezoidal shape.

10. The slapper detonator of claim 7, wherein the at least two light-confining features have a depth sufficient to confine the light without reducing a mechanical strength of the waveguide substrate enough to produce a high rate of breakage of the waveguide substrate.

11. The slapper detonator of claim 7, wherein the at least two light-confining features are regions of the waveguide substrate with a lower refractive index than a refractive index of the optical waveguide.

12. The slapper detonator of claim 7, wherein the guiding surface is proximate to the energetic material.

13. The slapper detonator of claim 7, further comprising a coating on a surface of the waveguide substrate that is opposite a surface of the waveguide substrate that is proximate to the energetic material.

14. The slapper detonator of claim 13, wherein the waveguide substrate is silicon and the coating is ZnS.

15. A method of spectroscopically interrogating a material in a detonator using an optical transducer integrated into the detonator, the method comprising:

inputting a probe light into an optical waveguide, the optical waveguide being proximate to an energetic material in the detonator;

outputting the probe light to a spectroscopic measurement system;

measuring an optical spectrum of the energetic material; and analyzing the optical spectrum to detect changes in the energetic material.

16. An explosive monitoring barrel assembly for a slapper detonator; the barrel assembly comprising an optical waveguide structure having an aperture therethrough oriented to permit passage of a flyer plate from a flyer plate assembly through the aperture to an energetic material; the optical waveguide structure comprising an optical waveguide that is positioned to be proximate to and in optical contact with the energetic material; and means for coupling light into and out of the optical waveguide.

* * * * *